US007518566B2

(12) United States Patent
Schoebel

(10) Patent No.: US 7,518,566 B2
(45) Date of Patent: Apr. 14, 2009

(54) WAVEGUIDE STRUCTURE FOR CREATING A PHASE GRADIENT BETWEEN INPUT SIGNALS OF A SYSTEM OF ANTENNA ELEMENTS

(75) Inventor: Joerg Schoebel, Salzgitter (DE)

(73) Assignee: Robert Bosch GmbH, Stuttgart (DE)

( * ) Notice: Subject to any disclaimer, the term of this patent is extended or adjusted under 35 U.S.C. 154(b) by 53 days.

(21) Appl. No.: 11/547,924

(22) PCT Filed: Mar. 4, 2005

(86) PCT No.: PCT/EP2005/050966

§ 371 (c)(1),
(2), (4) Date: Oct. 5, 2006

(87) PCT Pub. No.: WO2005/099042

PCT Pub. Date: Oct. 20, 2005

(65) Prior Publication Data

US 2007/0212008 A1 Sep. 13, 2007

(30) Foreign Application Priority Data

Apr. 7, 2004 (DE) ..... 10 2004 016 982

(51) Int. Cl.
*H01Q 13/00* (2006.01)
*H01Q 15/02* (2006.01)
*H01Q 15/24* (2006.01)
*H01Q 19/06* (2006.01)

(52) U.S. Cl. ..... 343/772; 343/909; 343/754

(58) Field of Classification Search ..... 343/700 MS, 343/754, 775, 753, 909, 772, 777, 778
See application file for complete search history.

(56) References Cited

U.S. PATENT DOCUMENTS

| | | | | |
|---|---|---|---|---|
| 4,051,476 | A * | 9/1977 | Archer et al. | 343/700 MS |
| 4,349,827 | A * | 9/1982 | Bixler et al. | 343/786 |
| 4,490,723 | A | 12/1984 | Hardie et al. | |
| 6,031,501 | A * | 2/2000 | Rausch et al. | 343/754 |
| 6,087,988 | A * | 7/2000 | Pozgay | 343/700 MS |
| 6,850,205 | B2 * | 2/2005 | Yamamoto et al. | 343/772 |

FOREIGN PATENT DOCUMENTS

| | | |
|---|---|---|
| GB | 2184607 | 6/1987 |
| JP | 54-120558 | 9/1979 |
| JP | 59160729 | 9/1984 |
| JP | 63226102 | 9/1988 |
| JP | 2220505 | 9/1990 |
| WO | 97/35358 | 9/1997 |

* cited by examiner

*Primary Examiner*—Hoang V Nguyen
*Assistant Examiner*—Robert Karacsony
(74) *Attorney, Agent, or Firm*—Kenyon & Kenyon LLP

(57) ABSTRACT

A planar waveguide structure for creating a phase gradient between the input signals of a system of antenna elements requires relatively little space and also ensures relatively low-loss beam deflection. The waveguide structure is provided on a dielectric microwave substrate, which has at least one conductive layer on both sides. At least one of the two conductive layers is structured and constitutes the signal side of the wave structure, while the other conductive layer is used as ground. The waveguide structure includes at least one parallel plate guide having beam lobe ports for signal feed and signal pickup. This parallel plate guide has a curved-shaped reflector contour so that it functions as a signal reflector.

20 Claims, 5 Drawing Sheets

WAVEGUIDE STRUCTURE FOR CREATING A PHASE GRADIENT BETWEEN INPUT SIGNALS OF A SYSTEM OF ANTENNA ELEMENTS

FIELD OF THE INVENTION

The present invention relates to a waveguide structure for creating a phase gradient between the input signals of a system of antenna elements. The waveguide structure is provided on a dielectric microwave substrate which has at least one conductive layer on both sides. At least one of the two conductive layers is structured and constitutes the signal side of the waveguide structure, while the other conductive layer is used as ground. The waveguide structure includes at least one parallel plate guide having beam lobe ports for signal feed and signal pickup.

BACKGROUND INFORMATION

In industrial applications, waveguide structures of this kind are used to create phased arrays in the microwave range. Due to the phase gradient $\phi$ between the input signals of adjacent antenna elements, their output signals are subject to phase lead/lag, and in consequence the azimuthal angle of the resulting phase front of the antenna output signal wave is modified.

There are many related-art civil and military radar and communications applications for microwave antennas having electronically swivelable or switchable lobes. One example is automotive radar systems for adaptive cruise control (ACC), which typically use multi-lobe monopulse radar. Herein, one or a plurality of antennas is used to create a plurality of lobes in the azimuthal plane, which overlap in pairs in some areas. In addition to ACC, future automotive applications include low-speed follow, stop-and-go, assisted reverse/park, blind-spot monitor, collision detection with collision-avoidance means or means for limiting collision severity via driving maneuvers, enhancing or deploying restraining devices, airbags, etc. The beam lobes in automobile radar sensors currently commercially available are usually created using a dielectric lens. Current research is geared towards a completely planar arrangement, i.e., radar sensors having a planar antenna and a planar waveguide lens structure for beam shaping connected in series, which is advantageous from a cost and space standpoint.

In industrial applications, use of planar waveguide lens structures is known heretofore, e.g., a Rotman lens, which at its outputs creates a phase gradient that is dependent on the selected input. The antenna elements are coupled to the outputs of a lens structure of this kind, and thus, depending on the selected input, create a beam lobe having beam deflection that is a function of the phase gradient. Rotman lenses have good focusing properties, and the arrangement is flexible based on the desired phase gradients at the antenna ports. In industrial applications, lens structures of this kind are used in conjunction with a planar antenna having a plurality of fixed beam lobes, using planar microstrip technology. Herein, the elements of the lens are arranged as planar elements of a microstrip circuit on a microwave substrate, e.g., ceramic material, glass or filled plastics.

The basic arrangement of a Rotman lens is shown in FIG. 1. A parallel plate guide 1 is supplied on one side via beam lobe ports 2, which are connected, via microstrips 3 and, if necessary, via a changeover switch for selecting a beam lobe, to a send/receive circuit (not shown). In parallel plate guide 1, waves propagate to antenna ports 4. At antenna ports 4, the wave of parallel plate guide 1 passes to microstrip conductors 5, via which antenna elements 6 are coupled. Microstrip conductors 5 between antenna ports 4 and antenna elements 6 are arranged as equalizing conductors, having a variable length from the middle of parallel plate guide 1 outward. The contoured shape of parallel plate guide 1 and the lengths of equalizing conductors 5 determine the respective signal path length. They are arranged in such a way that in the case of a centrally positioned beam lobe port a phase gradient of zero is obtained at antenna elements 6, and the maximum predefined phase gradient is obtained in the case of the outermost beam lobe port.

The lens structure just described has various disadvantages which may make it unsuitable for industrial applications involving radar sensors. Losses in the lenses, in particular due to the equalizing conductors, are relatively high. Furthermore, parallel plate guides and equalizing conductors require a relatively large amount of space. As a general rule, there is a relatively large amount of irradiation loss at the sides of the lens structure and from the parallel plate guide. Moreover, when a Rotman lens is used the beam lobe ports are at a significant distance from the antenna. This means the sensor has to be relatively long in the direction of elevation, which is not favorable for automotive applications.

SUMMARY OF THE INVENTION

The exemplary embodiment and/or exemplary method of the present invention provides a planar waveguide structure (concerning the type described above) that requires relatively little space and also allows relatively low-loss beam deflection.

According to the exemplary embodiment and/or exemplary method of the present invention this is achieved by providing the parallel plate guide with a curved-shaped reflector contour, so that it functions as a signal reflector.

According to the exemplary embodiment and/or exemplary method of the present invention, it was determined that a defined beam deflection is achievable not only by using a lens structure but also via a reflector structure. In particular, it was determined that a suitable reflector structure is also achievable in the form of a planar waveguide structure on a microwave substrate, namely as a parallel plate guide having a curved-shaped reflector contour. The parallel plate guide has a plurality of beam lobe ports for signal feed and signal pickup, which are arranged in such a way that the signals, as a result of reflection via the curved-shaped reflector contour of the parallel plate guide, pass from the beam lobe ports to the connected antenna elements or from the antenna elements to the beam lobe ports. In so doing, a phase gradient between the output signals of the parallel plate guide is created, which is dependent on the beam lobe port in question. As a result, a planar array antenna connected to the outputs of the parallel plate guide is able to transmit a plurality of beam lobes having different angles of deflection.

By contrast with the Rotman lens, no equalizing conductors, via which loss would occur, are required, which is advantageous with regard to the size of the waveguide according to the exemplary embodiment and/or exemplary method of the present invention, which is of the order of magnitude of half the square of the width of the antenna. As the beam lobe ports are laterally adjacent to the antenna in the azimuthal plane, the shape of the waveguide structure according to the exemplary embodiment and/or exemplary method of the present invention in the direction of elevation is not as long and is therefore suitable for automotive applications.

There are basically a variety of options for implementing a curved-shaped reflector contour within the framework of the waveguide structure according to the exemplary embodiment and/or exemplary method of the present invention.

According to an advantageous type of embodiment, on the signal plane and on the ground plane the conductive layers of the parallel plate guide end along a curved line that forms the reflector contour. However, the curved-shaped reflector contour of the parallel plate guide may also be realized as appropriately arranged conductive through-channels between the conductive layers on the signal side and on the ground side, it being necessary for the distance between these through-channels, and the diameter of the through-channels, to be small relative to the wavelength of the guided wave. It is particularly advantageous if the curvature of the reflector contour is approximately parabolic. It is important to note that the focusing properties of the waveguide structure according to the exemplary embodiment and/or exemplary method of the present invention may be improved even further if the design deviates from a parabolic shape. Numerical optimization methods may be used to determine a reflector contour that evenly minimizes phase deviations at the focal points.

According to a particularly advantageous embodiment of the waveguide structure according to the exemplary embodiment and/or exemplary method of the present invention, microstrip conductors are provided in the conductive layer, which are connected to the beam lobe ports of the parallel plate guide via planar feed horns (guide tapers). It was found that bundling and irradiation can be determined based on the size of the feed horns, which helps reduce loss. Moreover, irradiation occurs only to a limited extent, thanks to the shape of the reflector structure.

The signals applied to the beam lobe ports may be guided to the reverse side of the microwave substrate via beam coupling or guide through-channels known as high-frequency "vias." If a multi-layer substrate is used, a high-frequency electronics system may be provided, which is advantageous in the case of certain applications.

The parallel plate guide of the waveguide structure according to the exemplary embodiment and/or exemplary method of the present invention may extend further on the antenna side, where it may have slits that function as antenna elements of an array antenna. In this case, radiation is relatively loss-free. According to another type of embodiment of the waveguide structure according to the present invention, antenna ports for coupling to the antenna elements are provided on the parallel plate guide. It is advantageous that this coupling is also implemented in the form of planar feed horns (guide tapers) and microstrip conductors.

According to an advantageous further refinement of the waveguide structure according to the exemplary embodiment and/or exemplary method of the present invention, dummy ports are provided in the conductive layer within the contour of the parallel plate guide. Dummy ports in the area between the beam lobe ports are used to decouple individual beam lobe ports from one another. Providing dummy ports in the area between the beam lobe ports and the reflector contour prevents undesirable reflection. These dummy ports too are advantageously in the form of planar feed horns, which are each closed off to ensure low reflection or lead to a low-reflection closed-off conductor.

The waveguide structure according to the exemplary embodiment and/or exemplary method of the present invention having a parallel plate guide, on which beam lobe ports and if necessary antenna ports and dummy ports are provided, may, in conjunction with all necessary connectors, be arranged as a completely planar microstrip structure on a microwave substrate.

As explained in detail above, there are various options for advantageously achieving what is provided by the exemplary embodiment and/or exemplary method of the present invention and for creating further refinements. Reference is made to the description below, which sets forth a plurality of exemplary embodiments of the present invention, including on the basis of the embodiments of the drawings.

DETAILED DESCRIPTION

Figure 1:
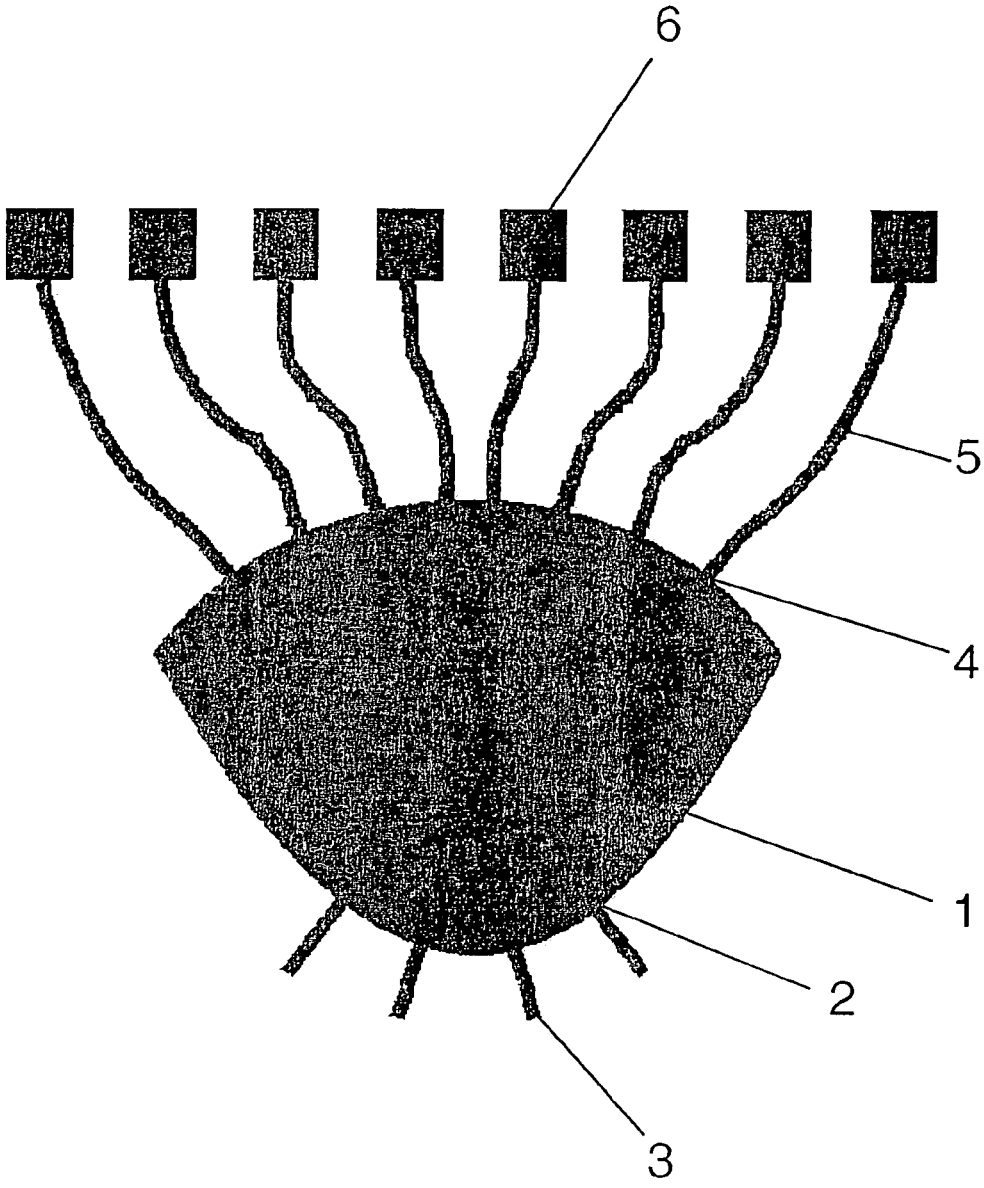
FIG. 1 shows the basic structure of a Rotman lens (related art).
Figure 2A:
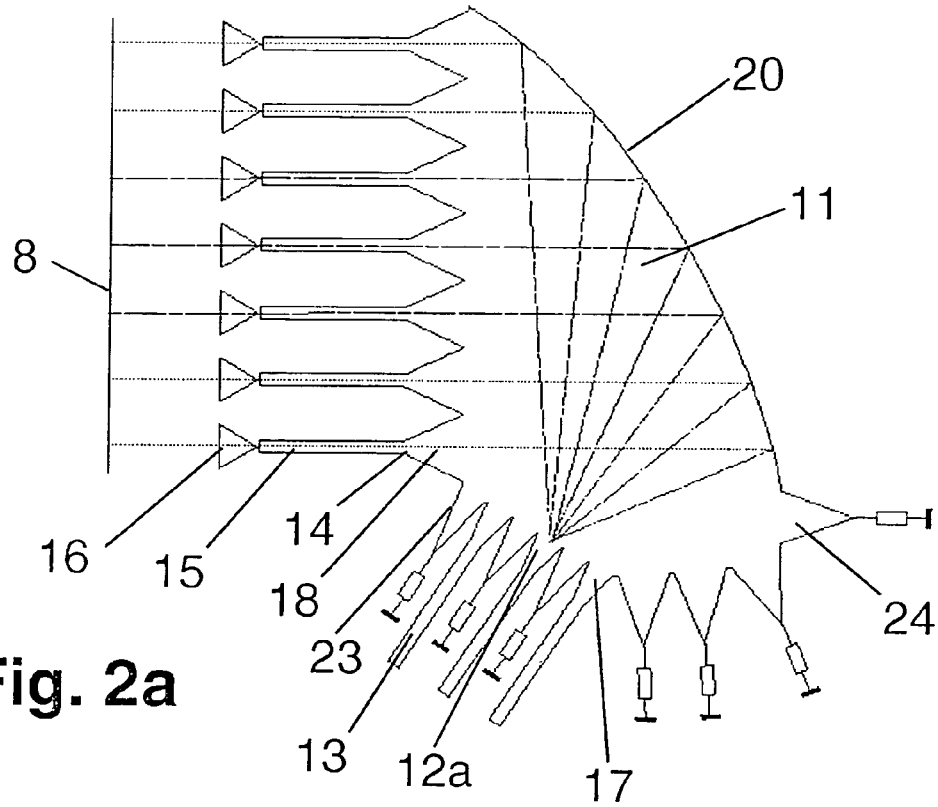
FIG. 2 shows a top view of a waveguide structure according to the exemplary embodiment and/or exemplary method of the present invention, having two different beam paths (FIG. 2*a* and FIG. 2*b*).
Figure 2B:
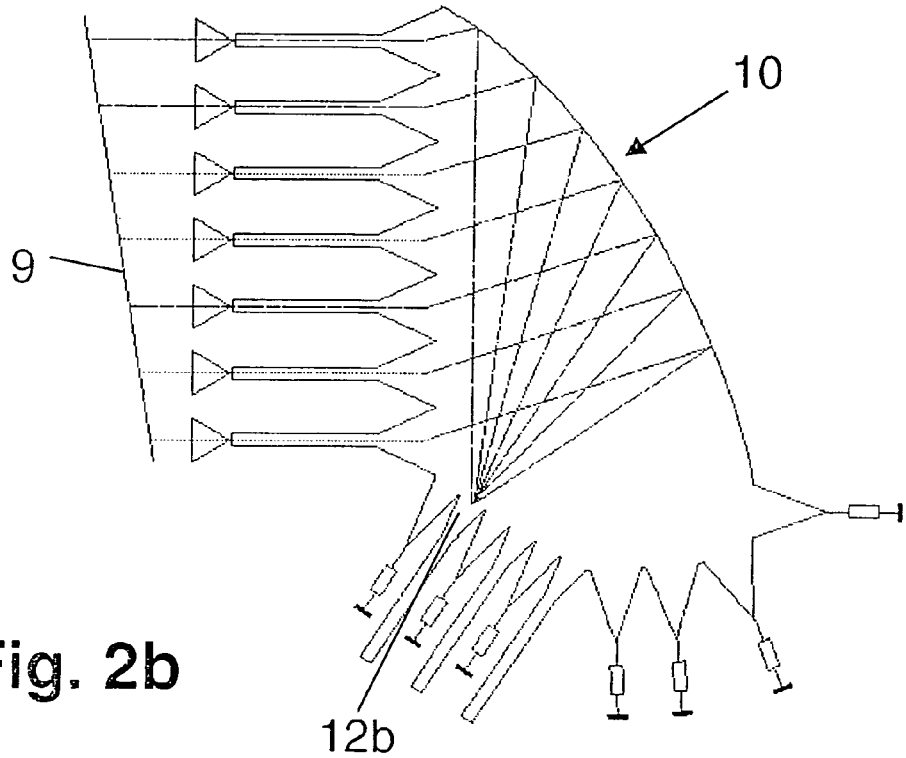

The waveguide structure 10 shown in FIGS. 2*a* and 2*b* is used to create a phase gradient between the input signals of a system of antenna elements 16.

Waveguide structure 10 is implemented using microstrip technology, as used in the manufacture of inexpensive high-frequency circuits. In the simplest case, a single-layer microwave substrate made of ceramic material, glass or filled plastic and metal plated on both sides is used. Parallel plate guide 11 having beam lobe ports 12 for signal feed and signal pickup is created by structuring the upper surface, which constitutes the signal side of waveguide structure 10 and is shown here. The metal plated bottom side serves as the ground of waveguide structure 10 and may also be structured. According to the exemplary embodiment and/or exemplary method of the present invention, parallel plate guide 11 has a curved-shaped reflector contour 20 so that it functions as a signal reflector. The curvature of reflector contour 20 is approximately parabolic.

In the conductive layer on the signal side, microstrip conductors 13 are provided, which are coupled to beam lobe ports 12 of parallel plate guide 11 via gradually broadening guide elements 17. These gradually broadening guide elements 17 are known as tapers or feed horns, because the wave propagation from the end of microstrip conductors which are extended in this way into a parallel plate guide is comparable to propagation into space via a horn antenna. Various types of embodiment of the tapers are known heretofore, e.g., exponential, linear or as Klopfenstein tapers.

In the exemplary embodiment shown here, parallel plate guide 11 also has antenna ports 14, which are also coupled via guide tapers 18 and microstrip conductors 15 to antenna elements 16.

Dummy ports 23 and 24 are also provided on the signal side on the contour of parallel plate guide 11. Each is in the form of a guide taper, which is closed off to minimize loss or leads to a low-loss closed-off conductor. The means for closing off the conductor may for example be implemented as a discreet resistor having a grounded through-channel, or a short circuit stub, or by providing absorber material on the conductor. Dummy ports 23 are provided between individual beam lobe ports 12, and are used to decouple beam lobe ports 12 from one another and to improve propagation of spherical waves emerging from feed horns 17, by preventing reflection or refraction of the wave against a metal edge located next to feed horn 17. Dummy ports 24 are positioned between beam lobe ports 12 and reflector contour 20, i.e., in the unused peripheral area of parallel plate guide 11, so as to prevent undesirable reflection.

The only respect in which FIGS. 2*a* and 2*b* differ is in the beam paths shown. In FIG. 2*a*, wave front 8, which is incident on the antenna front surface at a right angle, i.e., with a deflection angle of 0°, is shown. By contrast, wave front 9 shown in FIG. 2*b* is incident on the antenna front surface with a deflection angle not equal to 0°. Accordingly, the two shown wave fronts 8 and 9 are bundled at different beam lobe ports 12*a* and 12*b* by parallel plate guide 11 having reflector contour 20. Wave front 8 which is incident on the antenna front surface at a right angle is bundled at beam lobe port 12*a* which is situated centrally; wave front 9, which is incident on the antenna front surface with a deflection angle not equal to 0°, is bundled at outer beam lobe port 12*b*.

In the following explanation of the functioning of the planar reflector structure shown here, no distinction is made between transmitting and receiving, as the reflector structure has the same impact on the beam path in both instances.

Figure 3:
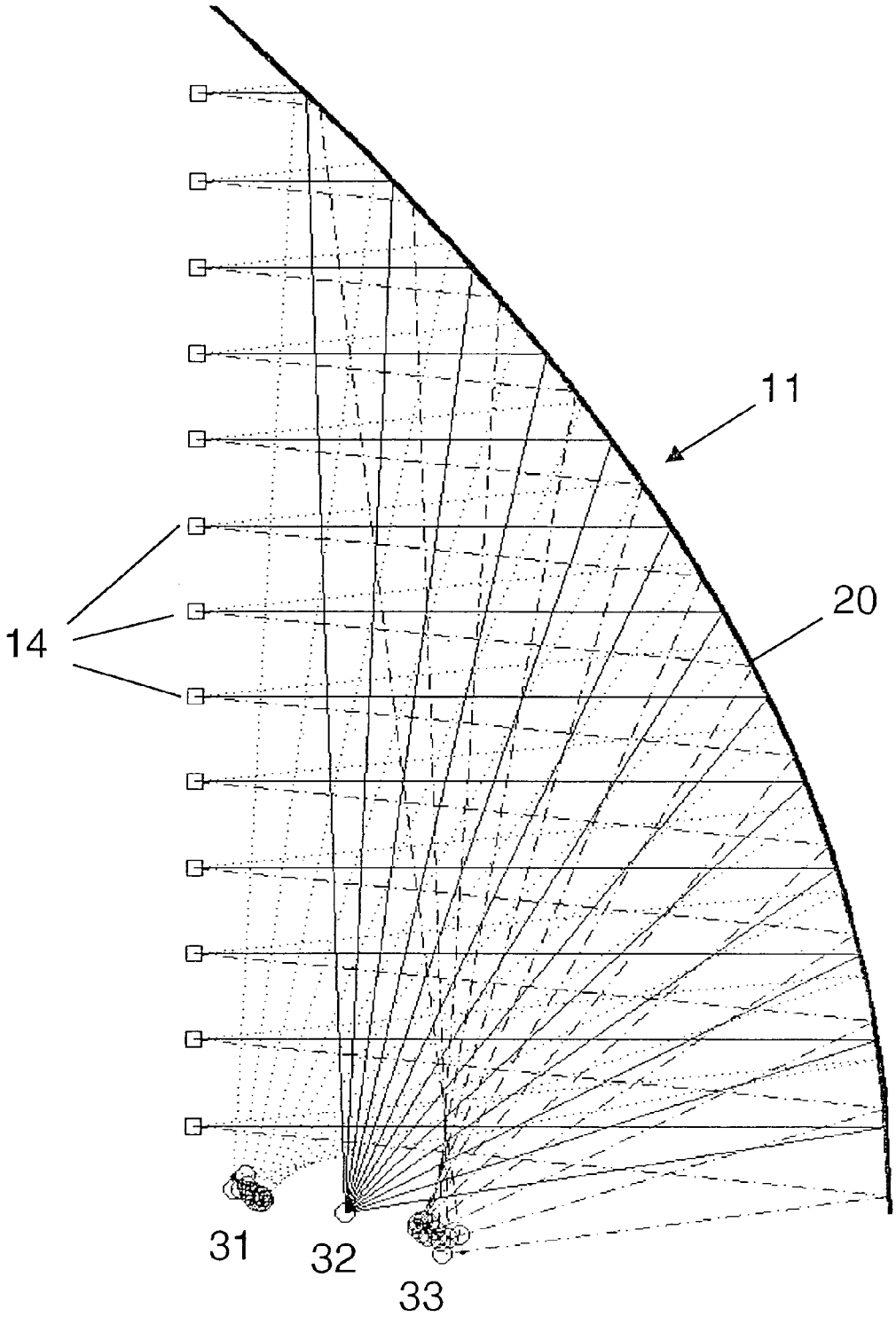
FIG. 3 shows focusing via a planar parabolic reflector, three beam paths being shown by way of example.

FIG. 3 shows parallel plate guide 11 shown in FIGS. 2*a* and 2*b* having curved-shaped reflector contour 20 and by way of example three beam paths in this parallel plate guide, which arise when three plane waves having different angles of deflection relative to the antenna front surface are received. In the case of transmission, these plane waves correspond to input signals at antenna ports 14, there being a phase gradient between respective adjacent antenna ports 14. If the antenna ports lead to antenna elements, these signals create beam lobes, each of which has a different angle of deflection relative to the antenna normal.

The signals are reflected on curved-shaped reflector contour 20 and in the case of receiving come together at three focal points 31, 32 and 33. Along with the "real" focal point 32 for the beam that is incident at a right angle to the antenna front surface, there are two focal spots 31 and 33 for the waves that are not incident at a right angle. The reflector contour may be subjected to numerical optimization methods to improve focusing properties so that the phase deviations at the focal points are evenly minimized. As a general rule, focal spots 31 and 33 are sufficiently small to ensure they can be picked up by a planar feed horn. The resulting phase errors are tolerable. The feed horns are positioned in such a way that their phase centers are located close to the points of minimum phase deviation, which may be determined via suitable averaging or numerical optimization methods. The orientation of the feed horns is chosen in such a way that in the case of transmission as little of the beam as possible is lost due to irradiation at the edges and in such a way that the radiation maximum is roughly in the middle of the antenna ports. This too may be accomplished via numerical optimization methods.

In the case of the waveguide structure described here, the antenna ports only have to illuminate a relatively small area of the reflector contour. Therefore they may be arranged to be relatively large, because radiation that passes from the antenna port to the accompanying beam lobe port comes only from the area of the reflector in front of the antenna port in question. By contrast, the beam lobe ports may be arranged to be relatively small, as they must illuminate the entire reflector contour.

Figure 4:
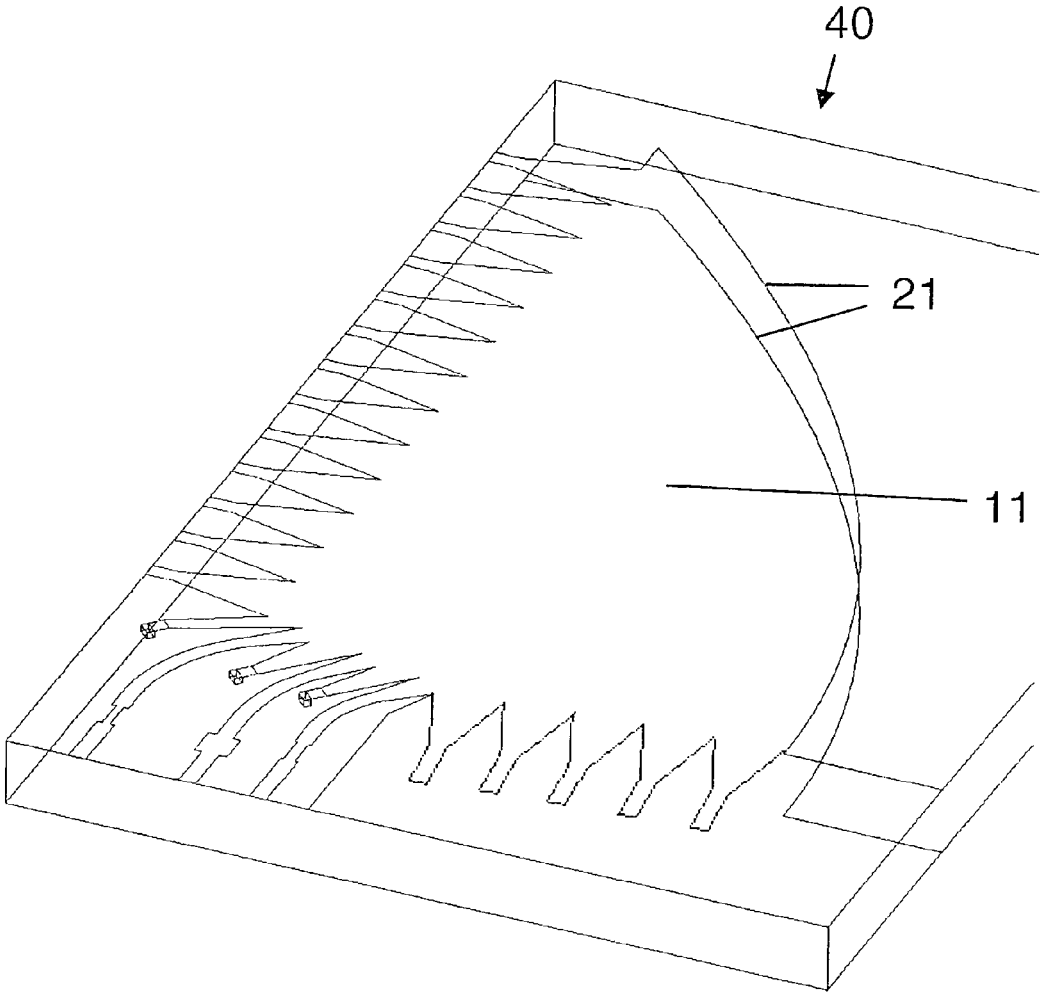
FIG. 4 shows a perspective view of a first waveguide structure according to the exemplary embodiment and/or exemplary method of the present invention.
Figure 5:
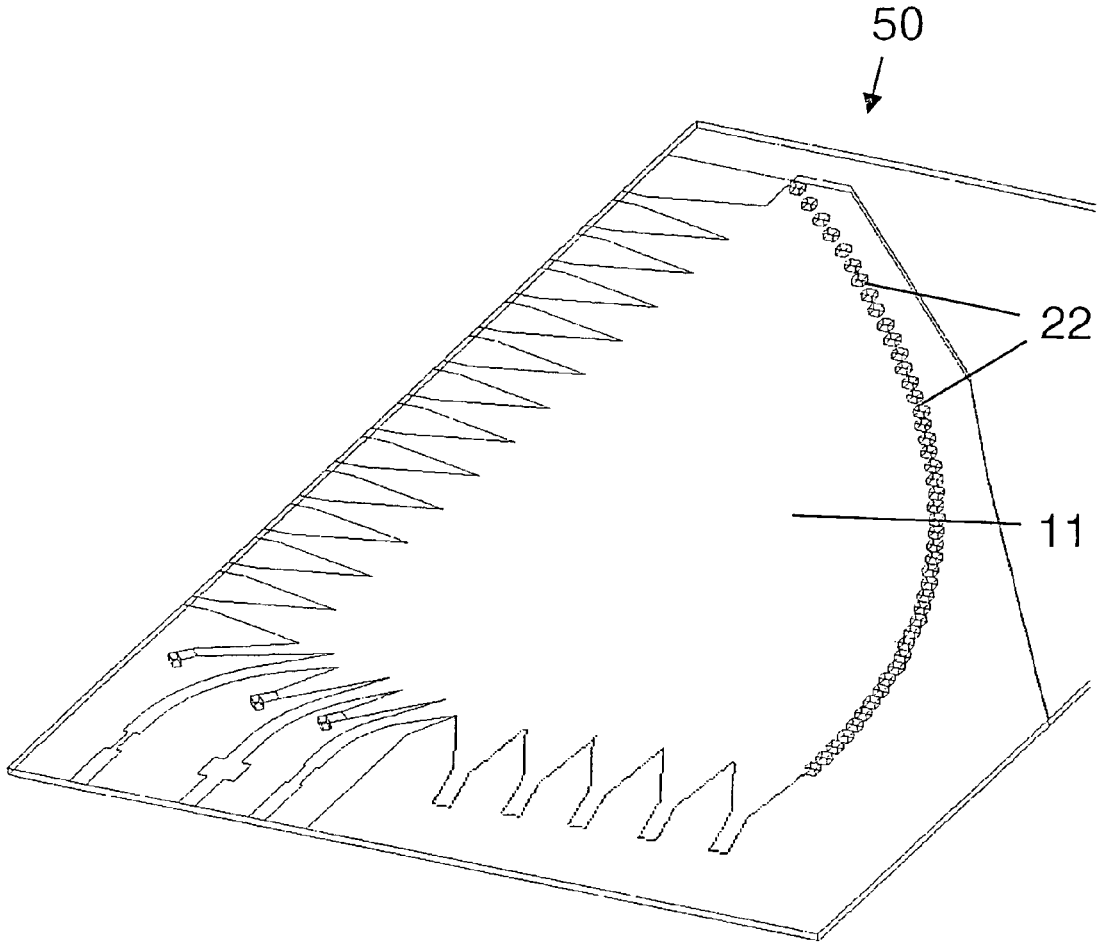
FIG. 5 shows a perspective view of a second waveguide structure according to the exemplary embodiment and/or exemplary method of the present invention.

FIGS. 4 and 5 show two waveguide structures 40 and 50 according to the exemplary embodiment and/or exemplary method of the present invention, which are provided on a microwave substrate in the form of a parallel plate guide having microstrip conductors, as already explained with reference to FIG. 2.

In the case of waveguide structure 40 shown in FIG. 4, the curved-shaped reflector contour of parallel plate guide 11 is realized in such a way that the metal plating on the signal plane and on the ground plane ends at curved lines 21 which extend parallel to one another. To accomplish this, the metal plating on the ground side of the microwave substrate as well as on the signal side must be structured appropriately.

The level of reflection at a reflector contour thus realized is very high. The guide impedance of the parallel plate guide for TEM mode is $Z_{pp}=(\mu/\in)^{1/2}\cdot d/w$, $\mu$ being the permeability, $\in$ being the dielectric constant of the microwave substrate, d being the thickness of the substrate and w being the width of the parallel plate guide. For a typical arrangement on "softboard" substrate ($\in_r=3$, d=130 μm, w=1.4 cm), $Z_{pp}=0.7 \ldots 2.8\ \Omega$. The structure "behind" the metal edge, which includes a non-metal plated substrate surrounded by air, constitutes a symmetrical dielectric waveguide. This guides a TM0 wave with no lower boundary frequency. By contrast with TE waves, TM waves are excited in a preferential manner by the TEM wave of the parallel plate guide, due to their field pattern. Because the substrate is thin, usually no higher TM waves arise. The TM0 wave of the dielectric waveguide is only conducted very weakly, because the thickness of the substrate, typically 130 μm, is significantly smaller than the wavelength of 3.9 mm at 77 GHz. Therefore the TM0 wave resembles a plane wave in air having free space impedance $Z_{free}=377\ \Omega$. Due to the large difference between $Z_{pp}$ and $Z_{free}$, the level of reflection at the edge of the reflector is very high.

In the case of waveguide structure 50 shown in FIG. 5, the curved-shaped reflector contour of parallel plate guide 11 is realized in such a way that metallic through holes 22 known as "vias" are provided between the metal layers of parallel plate guide 11 along a curved line. If the diameter of and the distance between through holes 22 are small relative to the wavelength, the electromagnetic wave is almost completely reflected.

What is claimed is:

1. A waveguide structure for creating a phase gradient between input signals of a system of antenna elements, comprising:

a waveguide arrangement on a dielectric microwave substrate having at least one conductive layer on both sides so that there are at least two conductive layers, at least one of the at least two conductive layers being structured and forming a signal side of the waveguide arrangement, another of the at least two conductive layers serving as ground;

wherein:

the waveguide includes at least one parallel plate guide having beam lobe ports for signal feed and signal pickup;

the parallel plate guide includes antenna ports which are coupled via planar feed horns and microstrip conductors to the antenna elements;

the parallel plate guide includes a curved-shaped reflector contour so that it functions as a signal reflector; and along the reflector contour of the parallel plate guide, conductive through holes are situated between the conductive layer on the signal side and the another conductive layer which is used as ground, the distance between the through holes and the diameter of the through holes being small relative to a wave length of a guided wave.

2. The waveguide structure of claim 1, wherein a curvature of the reflector contour is approximately parabolic.

3. The waveguide structure of claim 1, wherein there are microstrip conductors in the conductive layer on the signal side, and they are coupled via planar feed horns to the beam lobe ports of the parallel plate guide.

4. The waveguide structure of claim 3, wherein signals present at the beam lobe ports are guided via one of beam coupling and conductor through holes to a bottom side of the microwave substrate, which includes a high frequency electronics system.

5. The waveguide structure of claim 1, wherein in the conductive layer on the signal side there are dummy ports provided on the contour of the parallel plate guide.

6. The waveguide structure of claim 5, wherein there is a dummy port in the form of a planar feed horn, and it is closed off to ensure low reflection or leads to a low-reflection closed-off conductor.

7. A waveguide structure for creating a phase gradient between input signals of a system of antenna elements, comprising:

a waveguide arrangement on a dielectric microwave substrate having at least one conductive layer on both sides so that there are at least two conductive layers, at least one of the at least two conductive layers being structured and forming a signal side of the waveguide arrangement, another of the at least two conductive layers serving as ground;

wherein:

the waveguide includes at least one parallel plate guide having beam lobe ports for signal feed and signal pickup;

the parallel plate guide extends further on an antenna side and radiates via slits;

the parallel plate guide includes a curved-shaped reflector contour so that it functions as a signal reflector; and along the reflector contour of the parallel plate guide, conductive through holes are situated between the conductive layer on the signal side and the another conductive layer which is used as ground, the distance between the through holes and the diameter of the through holes being small relative to a wave length of a guided wave.

8. The waveguide structure of claim 7, wherein a curvature of the reflector contour is approximately parabolic.

9. The waveguide structure of claim 7, wherein there are microstrip conductors in the conductive layer on the signal side, and they are coupled via planar feed horns to the beam lobe ports of the parallel plate guide.

10. The waveguide structure of claim 9, wherein signals present at the beam lobe ports are guided via one of beam coupling and conductor through holes to a bottom side of the microwave substrate, which includes a high frequency electronics system.

11. The waveguide structure of claim 7, wherein in the conductive layer on the signal side there are dummy ports provided on the contour of the parallel plate guide.

12. The waveguide structure of claim 11, wherein there is a dummy port in the form of a planar feed horn, and it is closed off to ensure low reflection or leads to a low-reflection closed-off conductor.

13. An automobile radar system, comprising:

a waveguide structure for creating a phase gradient between input signals of a system of antenna elements, including:

a waveguide arrangement on a dielectric microwave substrate having at least one conductive layer on both sides so that there are at least two conductive layers, at least one of the at least two conductive layers being structured and forming a signal side of the waveguide arrangement, another of the at least two conductive layers serving as ground;

wherein:

the waveguide includes at least one parallel plate guide having beam lobe ports for signal feed and signal pickup;

the parallel plate guide includes antenna ports which are coupled via planar feed horns and microstrip conductors to the antenna elements;

the parallel plate guide includes a curved-shaped reflector contour so that it functions as a signal reflector; and along the reflector contour of the parallel plate guide, conductive through holes are situated between the conductive layer on the signal side and the another conductive layer which is used as ground, the distance between the through holes and the diameter of the through holes being small relative to a wave length of a guided wave.

14. The waveguide structure of claim 13, wherein a curvature of the reflector contour is approximately parabolic.

15. The waveguide structure of claim 13, wherein there are microstrip conductors in the conductive layer on the signal side, and they are coupled via planar feed horns to the beam lobe ports of the parallel plate guide.

16. The waveguide structure of claim 15, wherein signals present at the beam lobe ports are guided via one of beam coupling and conductor through holes to a bottom side of the microwave substrate, which includes a high frequency electronics system.

17. The waveguide structure of claim 13, wherein in the conductive layer on the signal side there are dummy ports provided on the contour of the parallel plate guide.

18. The waveguide structure of claim 17, wherein there is a dummy port in the form of a planar feed horn, and it is closed off to ensure low reflection or leads to a low-reflection closed-off conductor.

19. An automobile radar system, comprising:

a waveguide structure for creating a phase gradient between input signals of a system of antenna elements, including:

a waveguide arrangement on a dielectric microwave substrate having at least one conductive layer on both sides so that there are at least two conductive layers, at least one of the at least two conductive layers being structured and forming a signal side of the waveguide arrangement, another of the at least two conductive layers serving as ground;

wherein:

the waveguide includes at least one parallel plate guide having beam lobe ports for signal feed and signal pickup;

the parallel plate guide extends further on an antenna side and radiates via slits;

the parallel plate guide includes a curved-shaped reflector contour so that it functions as a signal reflector; and along the reflector contour of the parallel plate guide, conductive through holes are situated between the conductive layer on the signal side and the another conductive layer which is used as ground, the distance between the through holes and the diameter of the through holes being small relative to a wave length of a guided wave.

20. The waveguide structure of claim 19, wherein there are microstrip conductors in the conductive layer on the signal side, and they are coupled via planar feed horns to the beam lobe ports of the parallel plate guide.

* * * * *